US006757511B2

(12) United States Patent
Sugimoto et al.

(10) Patent No.: US 6,757,511 B2
(45) Date of Patent: Jun. 29, 2004

(54) IMAGE FORMING APPARATUS AND METHOD USING A MAGNETIC TONER BRUSH

(75) Inventors: Naomi Sugimoto, Kanagawa (JP); Tsukuru Kai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/075,402

(22) Filed: Feb. 15, 2002

(65) Prior Publication Data

US 2002/0114648 A1 Aug. 22, 2002

(30) Foreign Application Priority Data

Feb. 19, 2001 (JP) ..... 2001-041973
Jan. 25, 2002 (JP) ..... 2002-017465

(51) Int. Cl.[7] ..... G03G 15/09
(52) U.S. Cl. ..... 399/270; 399/277; 430/122
(58) Field of Search ..... 399/267, 270, 399/277; 430/122

(56) References Cited

U.S. PATENT DOCUMENTS 6,295,437 B1 9/2001 Hodoshima et al.
6,366,751 B1 4/2002 Shakuto et al.
6,385,423 B1 5/2002 Kai
6,449,452 B1 9/2002 Kai
2002/0028093 A1 * 3/2002 Miyoshi et al. ..... 399/267

FOREIGN PATENT DOCUMENTS

JP 2000-305360 11/2000
JP 2001-5266 1/2001

* cited by examiner

*Primary Examiner*—Joan Pendegrass
(74) *Attorney, Agent, or Firm*—Oblon, Spivak, McClelland, Maier & Neustadt, P.C.

(57) ABSTRACT

An image forming apparatus in which the flux density of a main magnetic pole for development has an attenuation ratio of 40% or above in the normal direction is disclosed. Assume that a period of time of T1 is necessary for a photoconductive element to move by a single dot at a nip for development. Also, assume that, in a single period of an alternating electric field applied to a developing sleeve as a bias, the duration of an electric field causing toner to move toward the photoconductive element is T2. Further, assume that the duration of an electric field causing the toner to move toward the sleeve is T3. Then, a relation of T1>T2>0 or a relation of T1>T3>0 holds.

38 Claims, 10 Drawing Sheets

FIG. 7

| FREQUENCY [kHz] | DUTY RATIO [%] | TIME T2 [μs] | TIME T3 [μs] | GRANULARITY RANK OF COMP EXAMPLE | GRANULARITY RANK OF EMBODIMENT |
|---|---|---|---|---|---|
| 1 | 30 | 300 | 700 | 2 | 2 |
| 1 | 40 | 400 | 600 | 1.5 | 1.5 |
| 1 | 50 | 500 | 500 | 1 | 1 |
| 2 | 40 | 200 | 300 | 2.5 | 2.5 |
| 2 | 50 | 250 | 250 | 2 | 2 |
| 3 | 50 | 166.7 | 166.7 | 3 | 3.5 |
| 3 | 70 | 233.3 | 100 | 2.5 | 3 |
| 4 | 10 | 25 | 225 | 3.5 | 4 |
| 4 | 30 | 75 | 175 | 3.5 | 4 |
| 4 | 50 | 125 | 125 | 3.5 | 4 |
| 4 | 70 | 175 | 75 | 3 | 3.5 |
| 4.5 | 10 | 22.2 | 200 | 3.5 | 4 |
| 4.5 | 30 | 66.7 | 155.6 | 3.5 | 4 |
| 4.5 | 50 | 111.1 | 111.1 | 3.5 | 4 |
| 4.5 | 70 | 155.6 | 66.7 | 3 | 3.5 |
| 5 | 10 | 20 | 180 | 3.5 | 4 |
| 5 | 30 | 60 | 140 | 3.5 | 4 |
| 5 | 50 | 80 | 100 | 3.5 | 4 |
| 5 | 70 | 140 | 60 | 3 | 3.5 |
| 7 | 30 | 42.9 | 100 | 3.5 | 4 |
| 7 | 50 | 71.4 | 71.4 | 3.5 | 4 |
| 7 | 70 | 100 | 42.9 | 3 | 3.5 |
| 8 | 50 | 62.5 | 62.5 | 3.5 | 4 |
| 8 | 60 | 75 | 50 | 3.5 | 4 |
| 9 | 50 | 55.6 | 55.6 | 3.5 | 4 |
| 9 | 60 | 66.7 | 44.4 | 3.5 | 4 |
| 10 | 50 | 50 | 50 | 3 | 3.5 |
| 10 | 60 | 60 | 40 | 3 | 3.5 |
| 11 | 50 | 45.5 | 45.5 | 3 | 3.5 |
| 11 | 60 | 54.5 | 36.4 | 3 | 3.5 |
| 12 | 50 | 41.7 | 41.7 | 3 | 3.5 |
| 12 | 60 | 50 | 33.3 | 3 | 3.5 |

IMAGE FORMING APPARATUS AND METHOD USING A MAGNETIC TONER BRUSH

BACKGROUND OF THE INVENTION

1. Field of the Invention

The present invention relates to an image forming apparatus of the type developing a latent image formed on an image carrier with a developer, which forms a magnet brush on a developer carrier.

2. Description of the Background Art

Generally, a copier, printer facsimile apparatus or similar electrophotographic or electrostatic image forming apparatus includes an image carrier implemented as a photoconductive drum or a photoconductive belt. A latent image is formed on the image carrier in accordance with image data. A developing device develops the latent image with toner to thereby produce a corresponding toner image. Today, magnet brush type development using a two-ingredient type developer, i.e., a toner and carrier mixture is predominant over development using a one-ingredient type developer, i.e., toner only. Magnet brush type development is desirable in the aspect of image transfer, reproduction of halftone, stable development against varying temperature and humidity, and so forth. The toner and carrier mixture rises on a developer carrier in the form of brush chains and feeds the toner to a latent image formed on the image carrier in a developing region. The developing region refers to a range over which the magnet brush on the developer carrier contacts the image carrier.

To further enhance image quality by development using the two-ingredient type developer, a halftone image portion must be freed from non-uniform toner deposition and granularity. A printer or a digital copier, for example, is required to uniformly form dots at the intervals of several ten micrometers for smoothly rendering halftone. In practice, toner fails to uniformly deposit over the area of a single a dot, as observed through, e.g., a microscope.

In light of the above, Japanese Patent Laid-Open Publication Nos. 7-114223 and 5-119592, for example, propose to use a bias for development that contains an oscillation component. Specifically, Laid-Open Publication No. 7-114223 discloses a method using a developer made up of toner having a mean grain size of 2 $\mu$m to 6 $\mu$m and carrier having a mean grain size of 45 $\mu$m or below. This method selects an AC frequency of 6 kHz or above and develops a digital latent image having 350 pixels for an inch or above. Laid-Open Publication No. 5-119592 teaches a method that confines the grain size of toner in the range of 6 $\mu$m and 11 $\mu$m and uses an AC frequency between 3 kHz and 16 kHz and a peak-to-peak voltage between 1 kV and 2.2 kV. This method, according to the above document, frees the toner from the force of inertia that would prevent the toner from sharply following the variation of an electric field, thereby implementing faithful toner deposition on a latent image.

However, we found by experiments that the conventional methods described above did not improve image quality, but rather degraded it, depending on the bias. For example, when the bias had a peak-to-peak voltage of 1 kV or above as in Laid-Open Publication No. 5-119592, granularity was aggravated. On the other hand, even when the AC frequency was lower than 6 kV proposed by Laid-Open Publication No. 7-114223, granularity was improved in some conditions. The frequency of 6 kV or above was apt to blur the trailing edge of a solid image; the effect of the AC bias was practically lost when the frequency was limitlessly raised. The differences between the experimental results are presumably ascribable to the movement of toner and carrier that are susceptible to other various factors. It may safely be said that the grain size of toner, AC frequency and peak-to-peak voltage cannot easily reduce granularity alone.

Technologies relating to the present invention are also disclosed in, e.g., Japanese Patent Laid-Open Publication Nos. 2000-305360 and 2001-5266.

SUMMARY OF THE INVENTION

It is an object of the present invention to provide an image forming apparatus capable of surely depositing toner on the individual dot at a nip to thereby form a uniform toner image and freeing a toner image on an image carrier from disturbance that brings about granularity.

In accordance with the present invention, in an image forming apparatus, the flux density of a main magnetic pole for development has an attenuation ratio of 40% or above in the normal direction is disclosed. Assume that aperiod of time of T1 is necessary for a photoconductive element to move by a single dot at a nip for development. Also, assume that, in a single period of an alternating electric field applied to a developing sleeve as abias, the duration of an electric field causing toner to move toward the photoconductive element is T2. Further, assume that the duration of an electric field causing the toner to move toward the sleeve is T3. Then, a relation of T1>T2>0 or a relation of T1>T3>0 holds.

BRIEF DESCRIPTION OF THE DRAWINGS

The above and other objects, features and advantages of the present invention will become more apparent from the following detailed description taken with the accompanying drawings in which:

FIG. 7 is a table listing experimental results comparing the illustrative embodiment and a comparative example as to granularity;

DESCRIPTION OF THE PREFERRED EMBODIMENT

Figure 1:
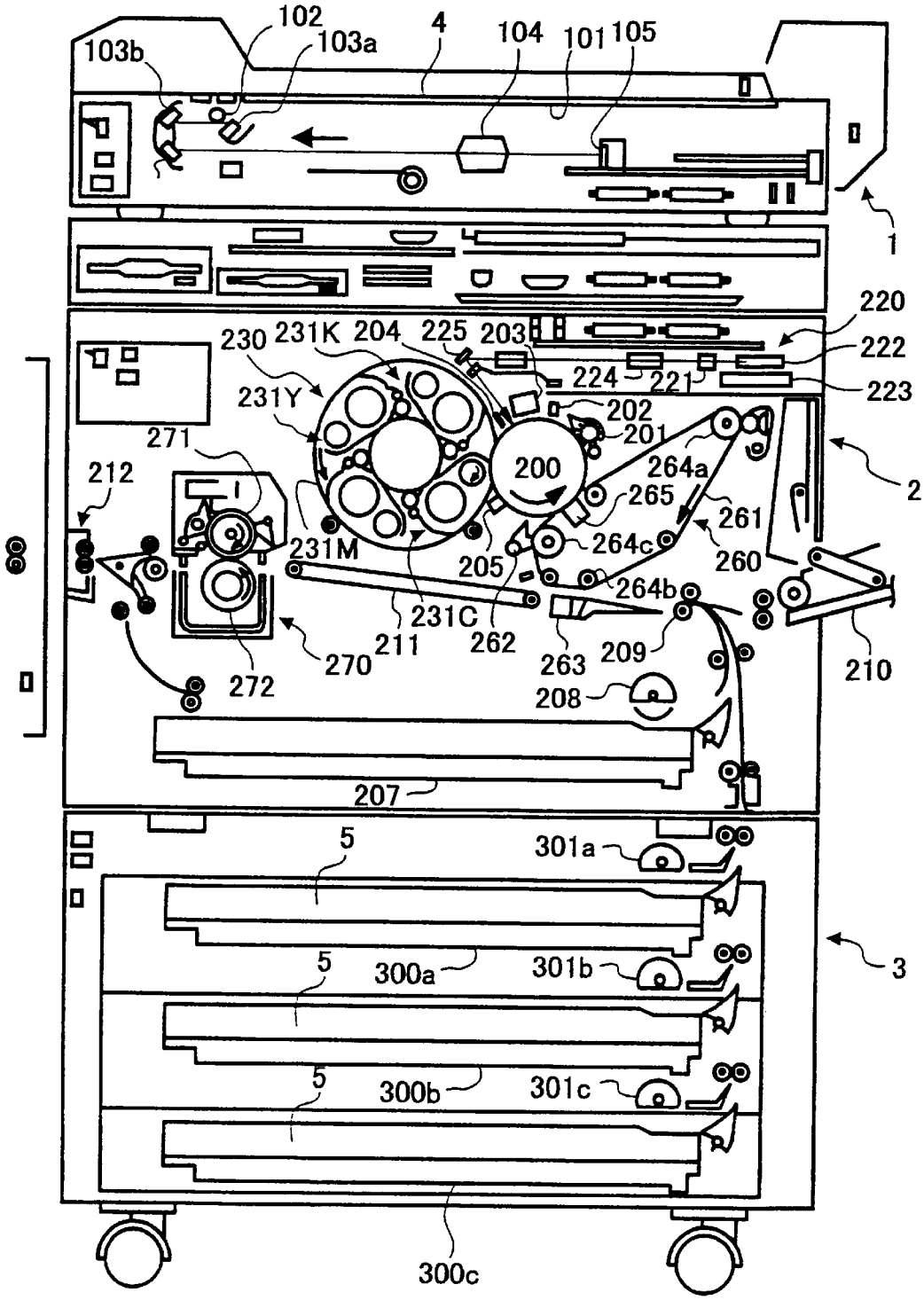
FIG. 1 is a front view showing an image forming apparatus embodying the present invention.

Referring to FIG. 1 of the drawings, an image forming apparatus embodying the present invention is shown and implemented as an electrophotographic color copier by way of example. As shown, the color copier is generally made up of a color scanner or color image reading device 1, a color printer or color image recording device 2, a sheet bank 3, and a control system that will be described later. The present invention is, of course, applicable to a monochromatic image forming apparatus as well.

The color scanner 1 includes a lamp 102 for illuminating a document 4 laid on a glass platen 101. The resulting reflection from the document 4 is incident to a color image sensor 105 via mirrors 103*a*, 103*b* and 103*c* and a lens 104. The color image sensor 105 reads color image information incident thereto color by color, e.g., red (R), green (G) and blue (B) image information while converting each of them to an electric signal. In the illustrative embodiment, the color image sensor 105 includes R, G and B color separating means and a CCD (Charge Coupled Device) array or similar photoelectric transducer. An image processing section, not shown, transforms the resulting R, G and B image signals to black (Bk), cyan (C), magenta (M) and yellow (Y) color image data in accordance with the intensity of the signal.

More specifically, in response to a scanner start signal synchronous to the operation of the color printer 2, which will be described later, the optics including the lamp 102 and mirrors 103*a* through 103*c* scans the document 4 in a direction indicated by an arrow in FIG. 1. The color scanner 1 outputs image data of one color every time it scans the document 4, i.e., outputs image data of four different colors by scanning the document 4 four consecutive times. The color printer 2 sequentially forms Bk, C, M and Y toner images while superposing them on each other, thereby completing a four-color or full-color toner image.

The color printer 2 includes a photoconductive drum or image carrier 200, an optical writing unit 220 and a revolver or developing device 230. The color printer 2 further includes an intermediate image transferring unit 260 and a fixing unit 270. The drum 200 is rotatable counterclockwise, as indicated by an arrow in FIG. 1. Arranged around the drum 200 are a drum cleaner 201, a discharge lamp 202, a charger 203, a potential sensor or charged potential sensing means 204, one of developing sections of the revolver 230 selected, a density pattern sensor 205, and a belt 261 included in the intermediate image transferring unit 260.

The optical writing unit 220 converts the color image data output from the color scanner 1 to a corresponding optical signal and scans the surface of the drum 4 in accordance with the optical signal. As a result, a latent image is electrostatically formed on the drum 200. The optical writing unit 220 includes a semiconductor laser or light source 221, a laser driver, not shown, a polygonal mirror 222, a motor 223 for driving the mirror 222, an f/θ lens 224, and a mirror 225.

The revolver 230 includes a Bk developing section 231K, a C developing section 231C, a M developing section 231M, a Y developing section 231Y, and a drive arrangement for causing the revolver 230 to bodily rotate counterclockwise, as indicated by an arrow in FIG. 1. The developing sections 231K through 231Y each include a developing sleeve or developer carrier and a paddle or agitator. The developing sleeve rotates with a developer forming a magnet brush thereon and contacting the surface of the drum 200 to thereby develop the latent image. The paddle scoops up the developer to the developing sleeve while agitating it. In the illustrative embodiment, the developer stored in each developing section is a toner and carrier mixture, i.e., a two-ingredient type developer. The toner is charged to negative polarity by being agitated together with the carrier. A bias power supply or bias applying means applies a bias for development to the developing sleeve. Consequently, the developing sleeve biases a metallic core layer included in the drum 200 to a preselected potential. In the illustrative embodiment, the above bias is implemented by a negative DC voltage Vdc biased by an AC voltage Vac.

While the color copier is in a standby state, the revolver 230 remains stationary with the Bk developing unit 231K facing the drum 200 at a developing position. On the start of a copying operation, the color scanner 1 starts reading Bk color image information at a preselected timing. A laser beam issuing from the semiconductor laser 221 starts forming a Bk latent image in accordance with Bk color image data derived from the Bk color image information. The Bk developing sleeve included in the Bk developing unit 231K starts rotating before the leading edge of the Bk latent image arrives at the developing position. As a result, Bk latent image is developed by Bk toner from the leading edge to the trailing edge. As soon as the trailing edge of the Bk latent image moves away from the developing position, the revolver 230 bodily rotates to bring the next developing section to the developing position. This rotation completes at least before the leading edge of the next latent image arrives at the developing position. The configuration and operation of the revolver 230 will be described more specifically later.

The intermediate image transferring unit 260 includes a belt cleaner 262 and a corona discharger 263 in addition to the previously mentioned belt 261. The belt 261 is passed over a drive roller 264*a*, a roller 264*b* located at an image transferring position, a roller 264*c* located at a cleaning position, and driven rollers. A motor, not shown, causes the belt 261 to turn. In the illustrative embodiment, the belt 261 is formed of ETFE (Ethylene TetraFluoroEthylene) and has electric resistance of $10^8$ Ω/cm$^2$ to $10^{10}$ Ω/cm$^2$ in terms of surface resistance. The belt cleaner 262 includes an inlet seal, a rubber blade, a discharge coil, and a mechanism for moving the inlet seal and rubber blade, although not shown specifically. While the transfer of images of the second to fourth colors from the drum 200 to the belt 261 is under way after the transfer of the image of the first color or Bk, the above mechanism maintains the inlet seal and rubber blade spaced from the belt 261. A DC voltage or an AC biased DC voltage is applied to the corona discharger 263. The corona discharger 263 collectively transfers the full-color image completed on the belt 261 to a paper sheet or similar recording medium.

The color printer 2 includes a sheet cassette 207 in addition to the sheet bank 3, which includes sheet cassettes 300*a*, 330*b* and 300*c*. The sheet cassettes 207 and 300*a* through 300*c* each are loaded with a stack of paper sheets 5 of a particular size. Pickup rollers 208 and 301*a*, 301*b* and 301*c* are respectively associated with the sheet cassettes 207 and 300*a*, 330*b* and 300*c*. One of the pickup rollers 208 through 301*c* pays out the sheets from associated one of the sheet cassettes 207 through 300*c* selected toward a registration roller pair 209. A manual feed tray 210 is available for feeding OHP (OverHead Projector) sheets, thick sheets and other special sheets by hand.

In operation, on the start of an image forming cycle, the drum 200 rotates counterclockwise while the belt 261 turns counterclockwise by being driven by the previously mentioned motor. In this condition, a Bk, a C, a M and a Y toner image are sequentially transferred from the drum 200 to the belt 261 one above the other, completing a full-color image.

More specifically, the charger 203 uniformly charges the surface of the drum 200 to a negative potential of about −700

V by corona discharge. The semiconductor laser 221 scans the charged surface of the drum 200 by raster scanning in accordance with a Bk color image signal. As a result, the charge of the drum 200 is lost in the scanned portion in proportion to the quantity of incident light, forming a Bk latent image. Bk toner charged to negative polarity and forming a magnet brush on the Bk developing sleeve contacts the Bk latent image. At this instant, the Bk toner deposits only on the scanned portion of the drum 200 where the charge is lost, thereby forming a Bk toner image. An image transferring device 265 transfers the Bk toner image from the drum 200 to the belt 261, which is turning in contact with and at the same speed as the drum 200. Let the image transfer from the drum 200 to the belt 261 be referred to as primary image transfer.

The drum cleaner 201 removes some Bk toner left on the drum 200 after the primary image transfer to thereby prepare the drum 200 for the next image formation. The toner removed by the drum cleaner 201 is collected in a waste toner tank via a piping, although not shown specifically.

The color scanner 1 starts reading C image data at a preselected timing. A C latent image is formed on the drum 200 in accordance with the C image data. After the trailing edge of the Bk latent image has moved away from the developing position, but before the leading edge of the C latent image arrives at the developing position, the revolver 230 rotates to bring the C developing section 231C to the developing position. The C developing section 231C develops the C latent image with C toner for thereby producing a corresponding C toner image. After the trailing edge of the C latent image has moved away from the developing position, the revolver 230 again rotates to bring the M developing section 231M to the developing position. This rotation also completes before the leading edge of the next or M latent image arrives at the developing position.

The formation of a M toner image and a Y toner image will not be described specifically because it is similar to the formation of the Bk and C toner images described above.

By the above procedure, the Bk, C, M and Y toner images are sequentially transferred from the drum 200 to the belt 261 one above the other. The corona discharger 263 collectively transfers the resulting full-color toner image from the belt 261 to the paper sheet 5. The transfer of the full-color toner image from the belt 261 to the paper sheet 5 will be referred to as secondary image transfer hereinafter.

More specifically, the paper sheet 5 is fed from any one of the sheet cassettes 207 and 300*a* through 300*c* or the manual feed tray 210 and once stopped by the registration roller pair 209. The registration roller pair 209 drives the paper sheet 5 at such a timing that the leading edge of the paper sheet 5 meets the trailing edge of the full-color toner image formed on the belt 261. The corona discharger 263 charges the paper sheet 5, which is superposed on the full-color toner image, to positive polarity. As a result, the toner image is almost entirely transferred from the belt 261 to the paper sheet 5. A discharger, not shown, located at the left-hand-side of the corona discharger 263 discharges the paper sheet 5 by AC+DC corona discharge, so that the paper sheet 5 is separated from the belt 261. The paper sheet 5 is then transferred to a conveyor 211 implemented as a belt.

The conveyor 211 conveys the paper sheet 5 carrying the toner image thereon to the fixing unit 270. In the fixing unit 270, a heat roller 271 and a press roller 272 cooperate to fix the toner image on the paper sheet 5 with heat and pressure. The paper sheet or full-color copy 5 coming out of the fixing unit 270 is driven out to a copy tray, not shown, face up.

After the secondary image transfer, the drum cleaner 201, which may be implemented as a brush roller or a rubber blade, cleans the surface of the drum 200. Subsequently, the discharge lamp 202 uniformly discharges the surface of the drum 200. At the same time, the inlet seal and rubber blade of the belt cleaner 262 are again pressed against the belt 261 to thereby clean the surface of the belt 261.

In a repeat copy mode, after the formation of the first Y toner image on the drum 200, the color scanner and drum 200 are operated to form the second Bk toner image. On the other hand, after the secondary transfer of the first full-color image from the belt 261 to the paper sheet 5, the second Bk toner image is transferred to the area of the belt 261 that has been cleaned by the belt cleaner 262.

In a bicolor or a tricolor copy mode, as distinguished from the above-described full-color copy mode, the same procedure is repeated a number of times corresponding to desired colors and a desired number of copies. Further, in a monocolor copy mode, one of the developing sections of the revolver 230 corresponding to a desired color is held at the developing position until a desired number of copies have been output. At the same time, the inlet seal and blade of the belt cleaner 262 are constantly held in contact with the belt 261.

Assume that the full-color copy mode operation is effected with paper sheets of size A3. Then, it is desirable to form a toner image of one color every time the belt 261 makes one turn and therefore to complete a full-color image by four turns of the belt 261. More preferably, however, a toner image of one color should be formed during two turns of the belt 261. This makes the entire copier small size, i.e., reduces the circumferential length of the belt 261 and guarantees a copy speed for relatively small sheet sizes while preventing the copy speed from decreasing for the maximum sheet sizes. In such a case, after the transfer of the Bk toner image from the drum 200 to the belt 261, the belt 261 makes one idle turn without any development or image transfer. During the next turn of the belt 261, the next or C toner image is formed and transferred to the belt 261. This is also true with the M and Y toner images. The revolver 230 is caused to rotate during the idle turn of the belt 261.

Figure 2:
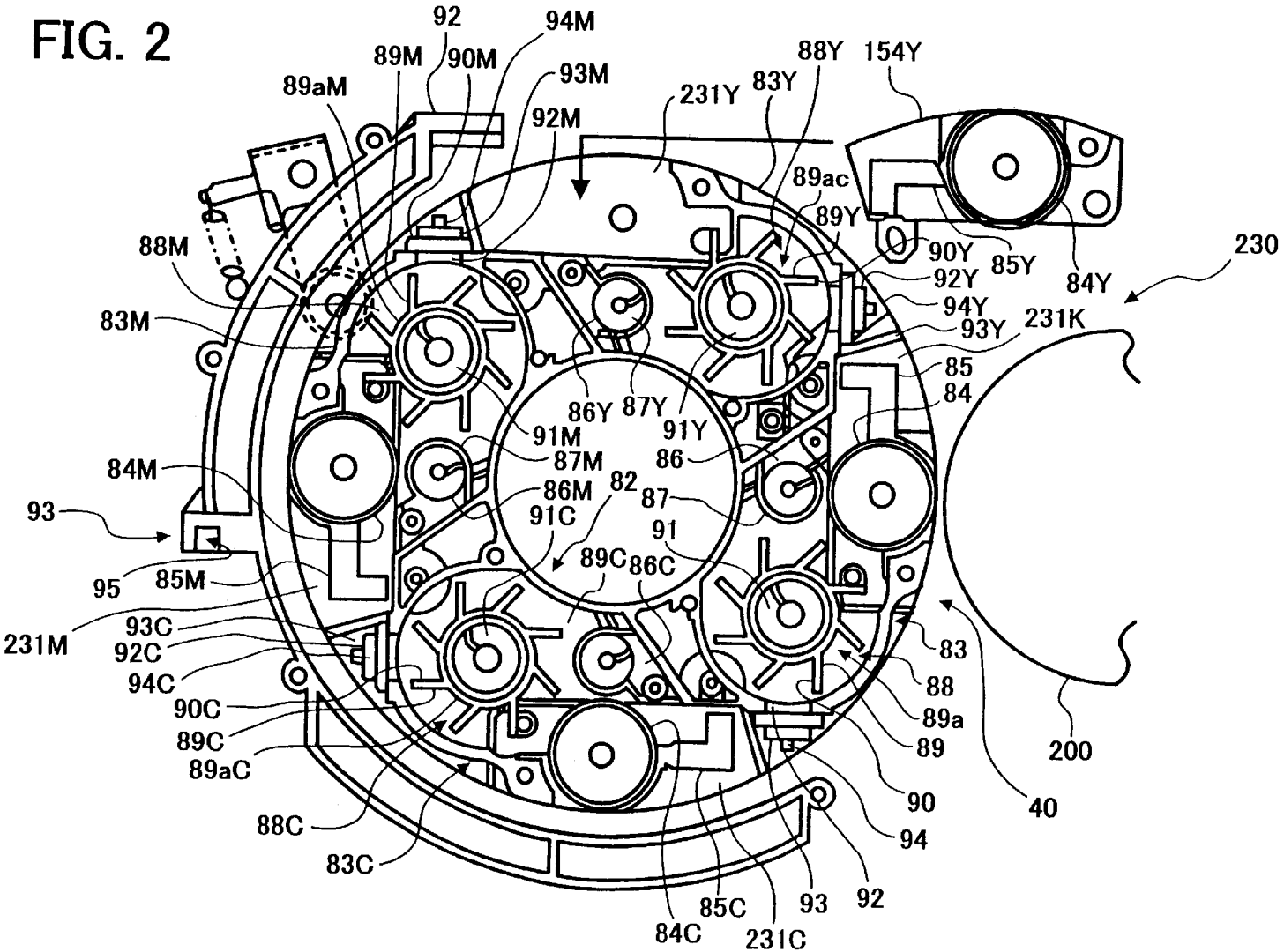
FIG. 2 is a section showing a revolver or developing device included in the illustrative embodiment.
Figure 3:
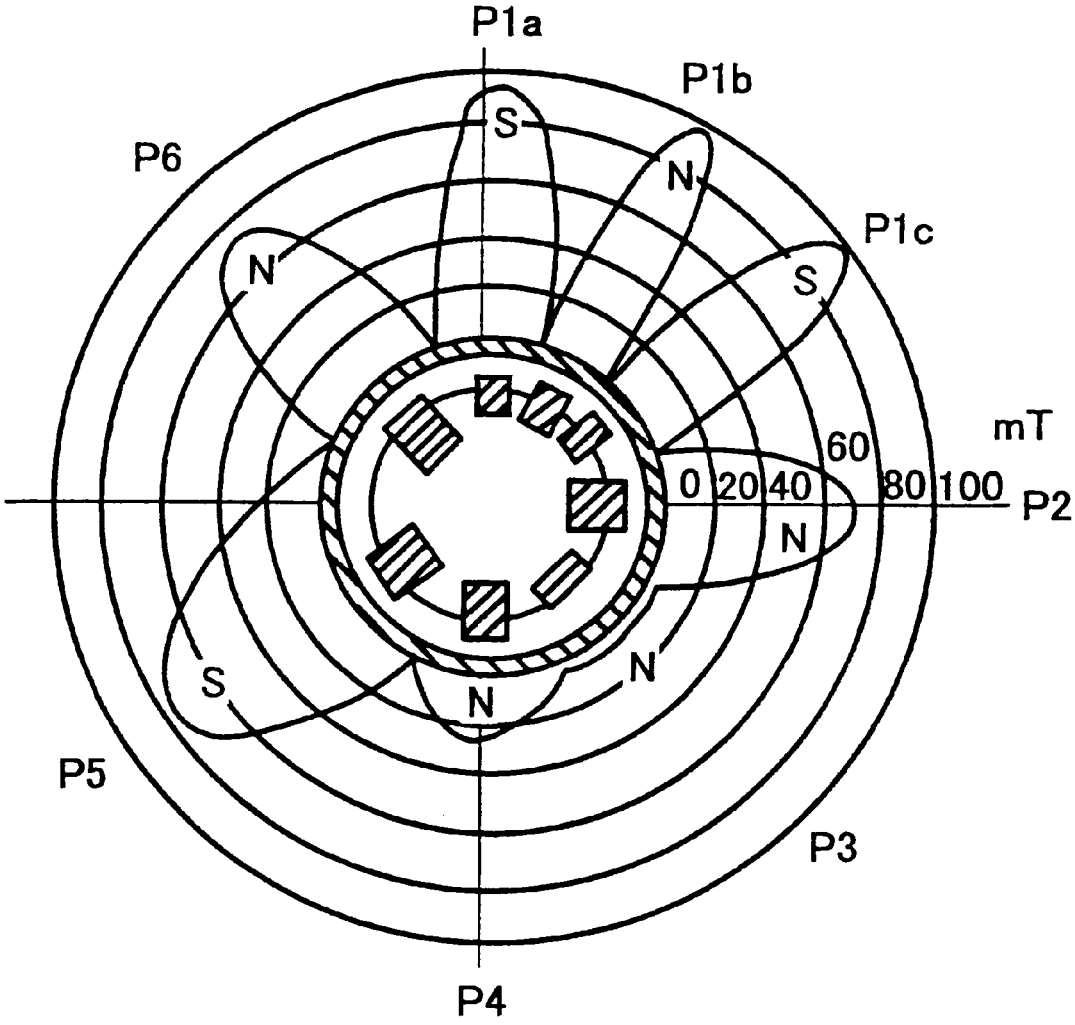
FIG. 3 is a chart showing the distribution and sizes of the magnetic forces of a magnet roller included in the revolver.

Reference will be made to FIG. 2 for describing the revolver 230 in detail. As shown, the revolver 230 includes a developing unit 40 including the developing sections 231K through 231Y. The developing unit 40 includes a pair of disk-like end walls and a partition wall supported by the end walls at opposite ends thereof. The partition wall includes a hollow, cylindrical portion 82 and four casing portions 83, 83C, 83M and 83Y extending radially outward from the cylindrical portion 82. The casing portions 83 through 83Y divide the space around the cylindrical portion 82 into four developing chambers, which are substantially identical in configuration, in the circumferential direction. The developing chambers each store the developer, i.e., toner and carrier mixture of a particular color. In the specificposition shown in FIG. 2, the developing chamber of the Bk developing section 231K, which stores the black toner and carrier mixture, is located at the developing position. This developing chamber is followed by the developing chambers of the Y developing section 231Y, M developing section 231M, and C developing section 231C in the counterclockwise direction.

The following description will concentrate on the black developing chamber located at the developing position by way of example. In FIG. 2, the yellow, magenta and cyan developing chambers are simply distinguished from the black developing chamber by suffixes Y, M and C.

In the Bk developing section 231K, the casing portion 83 is formed with an opening facing the drum 200. A developing roller or developer carrier 84 is made up of the developing sleeve and a magnet roller disposed in the developing sleeve. A doctor blade or metering member 85 regulates the amount of the developer deposited on and conveyed by the developing roller 84 to the developing position. An upper screw conveyor 86 conveys part of the developer removed by the doctor blade 85 from the rear to the front in the direction perpendicular to the sheet surface of FIG. 2. A guide 87 guides the screw conveyor 86. A paddle or agitator 88 agitates the developer stored in the developing chamber. The paddle 88 includes a hollow, cylindrical portion 89 formed with a plurality of holes 89*a* at spaced locations in the axial direction of the developing roller 84, and a plurality of blades 90 extending radially outward from the cylindrical portion 89. A lower screw conveyor 91 is disposed in the cylindrical portion 89 and extends in the axial direction of the paddle 88. The lower screw conveyor 91 conveys the developer in the opposite direction to the upper screw conveyor 86. The casing portion 83 is additionally formed with a slot 92 below the lower screw conveyor 91. The slot 92 extends in the axial direction of the developing unit 40 and may be used to discharge the developer deteriorated or to charge a fresh developer, as desired. A cap 93 is fastened to the casing portion 83 by, e.g., screws 94.

In the illustrative embodiment, the drum 200 has a diameter of 90 nm and moves at a linear velocity of 200 mm/sec. The developing sleeve, i.e., the developing roller 84 has a diameter of 30 mm and moves at a linear velocity of 260 mm/sec, which is 1.3 times as high as the linear velocity of the drum 1. A development gap between the drum 200 and the developing roller 84 is 0.35 mm or 0.4 mm. The magnet roller disposed in the developing roller 84 causes the developer deposited on the roller 84 to rise in the form of a magnet brush. More specifically, the carrier of the developer rises in the form of chains on the developing roller 84 along magnetic lines of force issuing from the magnet roller. The charged toner deposit on the carrier to thereby form a magnet brush.

Figure 4:
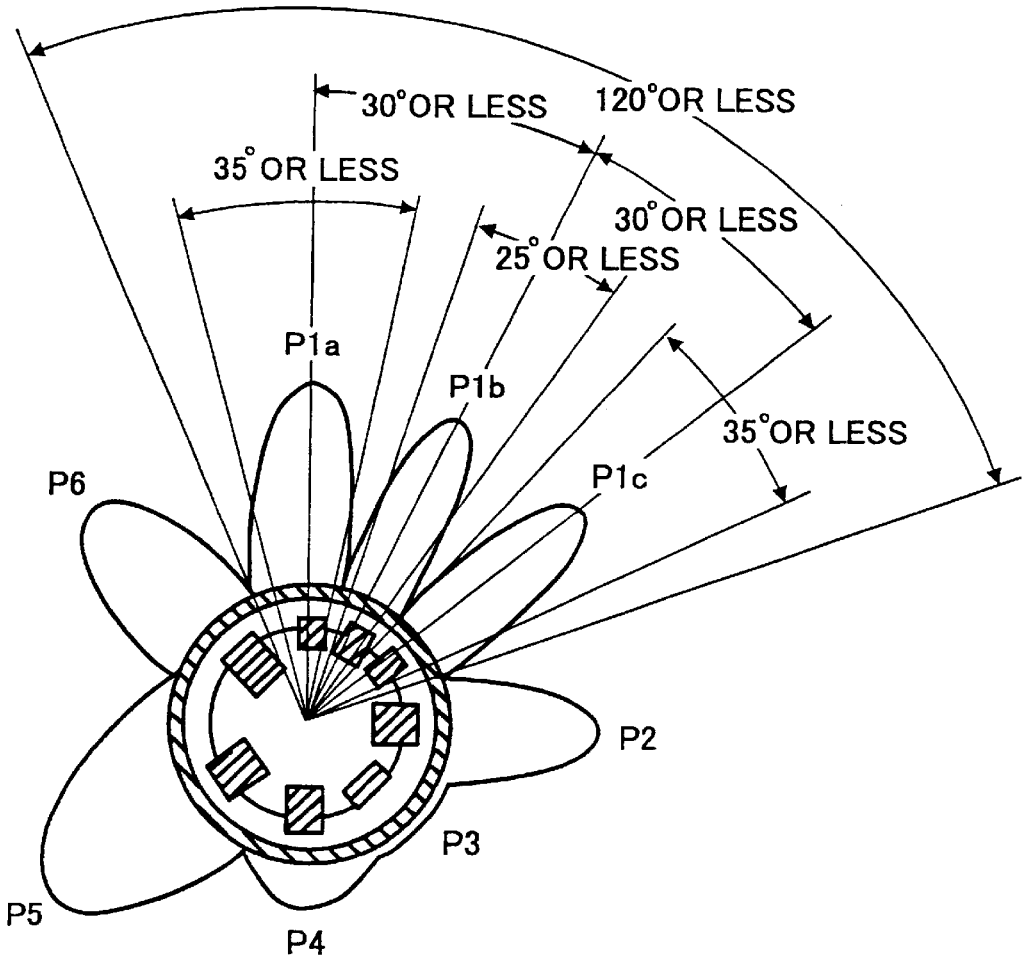
FIG. 4 is a view showing a positional relation between a main pole and auxiliary poles included in the magnet roller.

As shown in FIG. 4, the magnet roller has a plurality of magnetic poles or magnets P1*a* through P1*c* and P2 through P6. The pole or main pole P1*b* causes the developer to rise in a developing region where the sleeve developing roller 84 and drum 200 face each other. The poles P1*a* and P1*c* help the main pole P1*b* exert such a magnetic force. The pole P4 scoops up the developer to the developing sleeve. The poles P5 and P6 convey the developer to the developing region. The poles P2 and P3 convey the developer in a region following the developing region. All of the poles of the magnet roller are oriented in the radial direction of the developing sleeve. While the magnet roller is shown as having eight poles, additional poles may be arranged between the pole P3 and the doctor blade 85 in order to enhance the scoop-up of the developer and the ability to follow a black solid image. For example, two to four additional poles may be arranged between the pole P3 and the doctor blade 85.

The poles P1*a* through P1*c* are sequentially arranged from the upstream side to the downstream side in the direction of developer conveyance, and each is implemented by a magnet having a small sectional area. While such magnets are formed of a rate earth metal alloy, they may alternatively be formed of, e.g., a samarium alloy, particularly a samarium-cobalt alloy. An iron-neodium-boron alloy, which is a typical rare earth metal alloy, has the maximum energy product of 358 kJ/m$^3$. An ion-neodium-boron alloy bond, which is another typical rare earth metal, has the maximum energy product of 80 kJ/m$^3$ or so. Such magnets guarantee magnetic forces required of the surface of the developing roller 41 despite their small sectional area. A ferrite magnet and a ferrite bond magnet, which are conventional, respectively have the maximum energy products of about 36 kJ/m$^3$ and 20 kJ/m$^3$. If the sleeve is allowed to have a greater diameter, then use may be made of ferrite magnets or ferrite bond magnets each having a relatively great size or each having a tip tapered toward the developing sleeve in order to reduce a half width.

It is to be noted that the half width mentioned above refers to the angular width of a portion where the magnetic force is one half of the maximum or peak magnetic force of a magnetic force distribution curve normal to the developing sleeve. For example, if the maximum magnetic force of an N magnet in the normal direction is 120 mT, then the half-width (50%) is 60 mT. It was experimentally found that when the half width was reduced, the attenuation ratio of the flux densityin the normal direction increased. To determine an attenuation ratio, a difference between the peak value of flux density on the sleeve surface in normal direction and the peak value of flux density at a distance of 1 mm from the sleeve surface is divided by the former peak value. A decrease in the attenuation ratio of a magnetic pole translates into a decrease in the width over which the developer rises in the form of brush chains. This successfully reduces the width of the nip for development.

In the illustrative embodiment, the main pole P1*b* and poles P4, P6, P2 and P3 are N poles while the poles P1*a*, P1*c* and P5 are S poles. For example, the main magnet P1*b* had a magnetic force of 85 mT or above in the normal direction, as measured on the developing roller. It was experimentally found that if the main pole P1*b* had a magnetic force of 60 mT or above, defects including the deposition of the carrier were obviated. The deposition of the carrier occurred when the above magnetic force was less than 60 mT. The magnets P1*a* through P1*c* each had a width of 2 mm while the magnet P1*b* had a half width of 16°. By further reducing the width of the magnet, the half width was further reduced. A magnet had a half value of 12° when the width was 1.6 mm. It is to be noted that the developer can be supplied to the main pole P1*b* without effecting an image even when the auxiliary magnet P1*c* is positioned downstream of the main pole P1*b* alone.

FIG. 4 shows a positional relation between the main magnet P1*b* and the auxiliary magnets P1*a* and P1*c*. As shown, the half width of each of the auxiliary magnets P1*a* and P1*c* is selected to be 35° or below. This half width cannot be reduced relatively because the magnets P2 and P6 positioned outside of the magnets P1*a* and P1*c* have great half widths. The angle between each of the auxiliary magnets P1*a* and P1*c* and the main magnet P1*b* is selected to be 30° or below. More specifically, because the half width of the main pole P1*a* is 16°, the above angle is selected to be 22°. Further, the angle between the transition point (0 mT) between the magnets P1*a* and P6 and the transition point (0 mT) between the magnets P1*c* and P2 is selected to be 120° or below. The transition point refers to a point where the N pole and S pole replace each other.

At the nip formed between the developing roller 84 and the drum 200, the attenuation ratio of the flux density of the main pole in the normal direction is 40% or above (25° or below in terms of half width) that insures desirable image density and image quality. More preferably, the attenuation ratio should be 50% or above, i.e., the half width should preferably be 22° or below.

Figure 5:
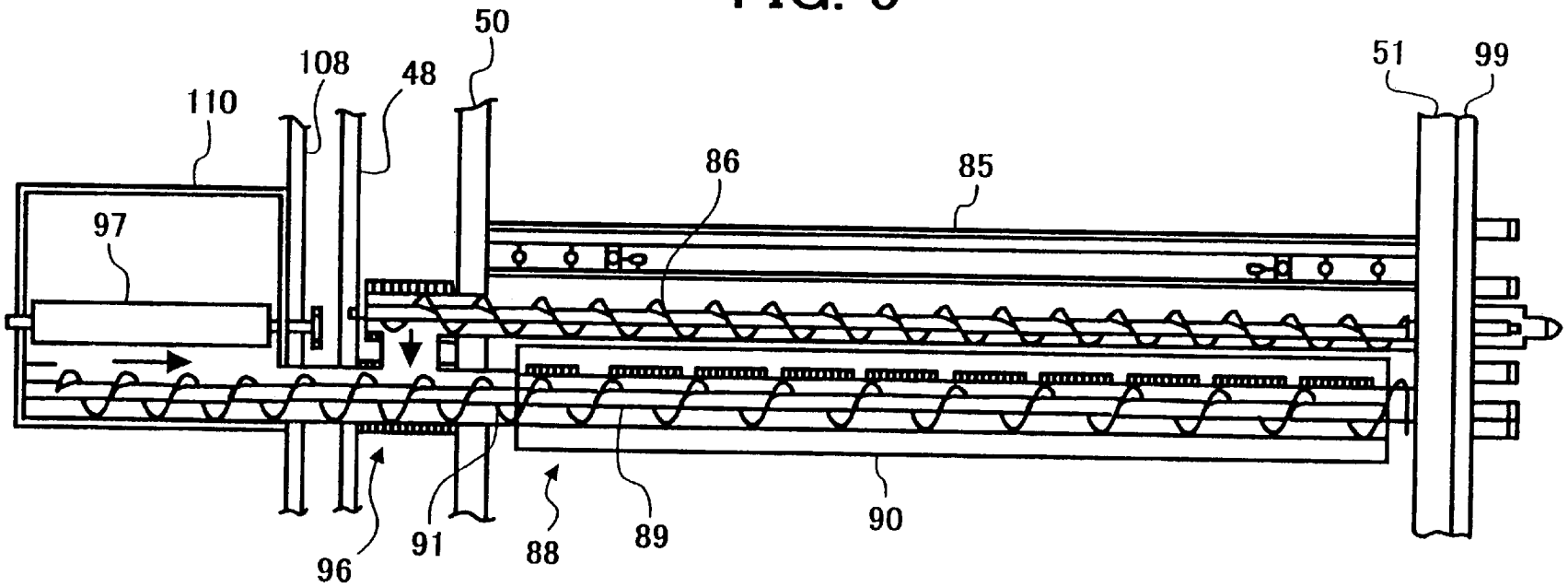
FIG. 5 is a view showing a structure in which a developing section included in the revolver and a toner container are connected to each other.

FIG. 5 is a section showing the black developing section 231K in a plane containing the axes of the upper and lower screw conveyors 86 and 91. As shown, the front ends of the screw conveyors 86 and 91 extend to the outside of the effective axial range of the developing roller 84, i.e., to the outside of the front end wall 50 of the developing unit 40 in the illustrative embodiment. The developer conveyed by the screw conveyor 86 drops onto the screw conveyor 91 via a drop portion 96 due to its own weight.

The front end of the screw conveyor 91 further extends via the drop portion 96 to a communication chamber positioned below a toner replenishing roller 97. The toner replenishing roller 97 is included in a toner storing unit, not shown, assigned to each developing chamber. In this configuration, the developer removed by the doctor blade 85, conveyed by the screw conveyor 86 and then dropped via the drop portion 96 is conveyed by the screw conveyor 91 to the effective axial range of the developing roller 84. The developer is then introduced into the developing chamber via the holes of the hollow, cylindrical portion of the paddle and again deposited on the developing roller 84. That is, the developer is agitated in the horizontal direction in the developing chamber. The paddle 88 in rotation agitates the above developer introduced into the developing chamber with its blades in the vertical direction.

Further, the toner replenishing roller 97 in rotation causes fresh toner to drop onto part of the screw conveyor 91 existing in the communication chamber. The screw conveyor 91 conveys the fresh toner to the drop portion 96. As a result, the fresh toner is mixed with the developer dropped from the screw conveyor 86 and then fed to the developing chamber via the holes of the cylindrical portion of the paddle, increasing the toner content of the developer.

Figure 6:
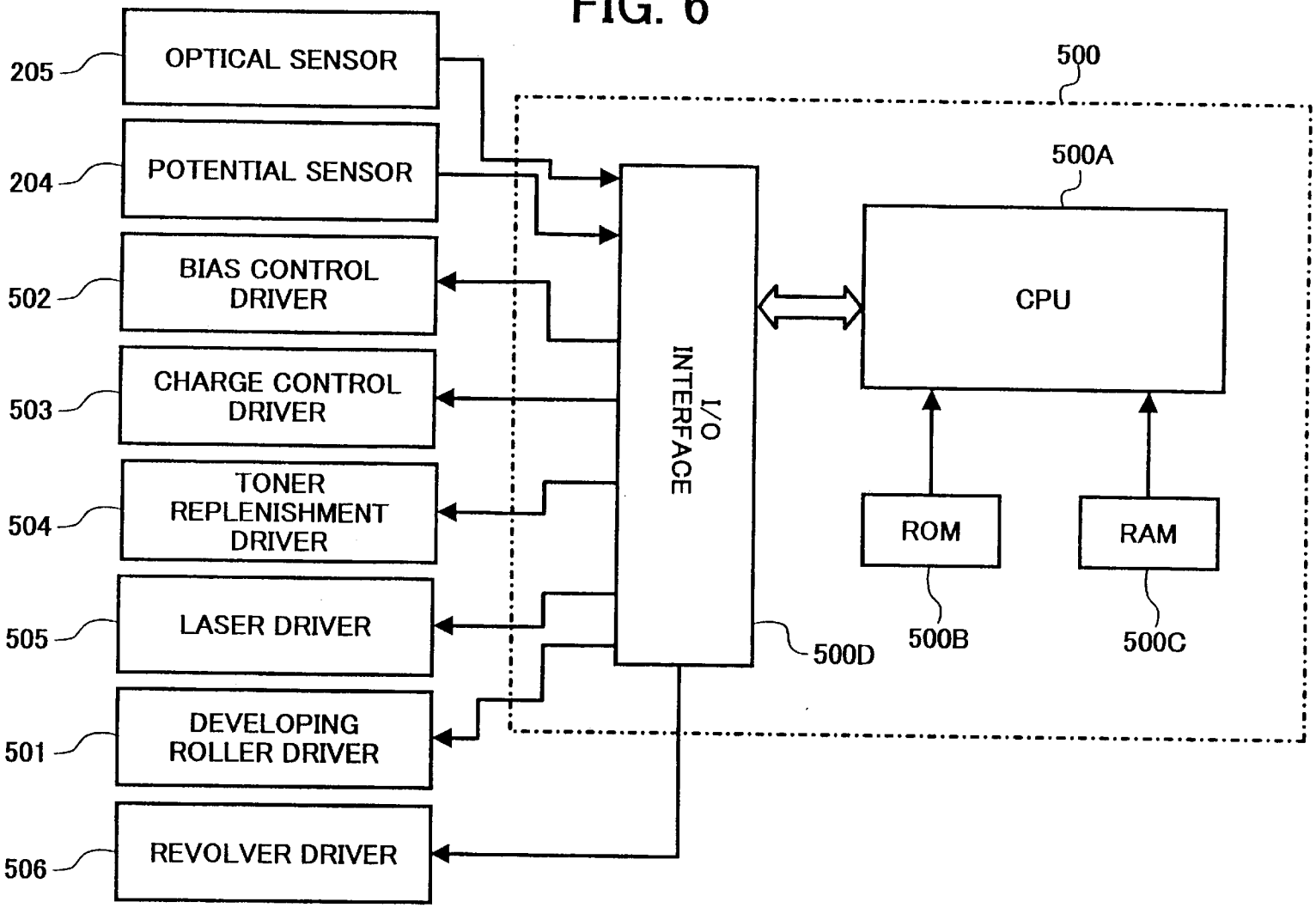
FIG. 6 is a block diagram schematically showing a control system included in the illustrative embodiment.

FIG. 6 shows a control system included in the illustrative embodiment. As shown, the control system includes a controller 500. The controller 500 includes a CPU (Central Processing Unit) 500A, a ROM (Read Only Memory) 500B connected to the CPU 500A, and a RAM (Random Access Memory) also connected to the CPU 500A. The ROM 500B stores a basic program and basic data for executing the program. The RAM 500C stores various kinds of interim data. The potential sensor 204 and density pattern sensor 205 are connected to the CPU 500A via an I/O (Input/Output) interface 500D. The density pattern sensor 205 is made up of a light emitting element and a light-sensitive element. The potential sensor 204 senses the potential of the drum 200 at a position upstream of the developing position. Also connected to the CPU SOA via the I/O interface 500D are a developing roller driver 501, a bias control driver or bias switching means 502, a charge control driver or charge potential switching means 503, a toner replenishment driver 504, a laser driver 505, and a revolver driver 506.

The bias control driver 502 causes an AC-biased DC voltage for development to be applied to the rod-like terminal 106. The bias control driver 502 is capable of selectively applying or stopping applying the AC voltage independently of the DC voltage in accordance with a control signal output from the controller 500. In addition, the bias control driver 502 is capable of varying the DC voltage at a preselected timing in accordance with a control signal also output from the controller 500.

The charge control driver 503 is connected to the charger 203 in order to apply a bias to the charger 203. The charge control driver 503 is capable of varying the above bias at a preselected timing in accordance with a control signal output from the controller 500.

To estimate granularity, experiments were conducted with the color copier of the illustrative embodiment and a comparative example, as will be described hereinafter. The comparative example was implemented as a conventional image forming apparatus with a developing device in which a main pole had a half width of about 48° and was not accompanied by auxiliary poles. As for image forming conditions, the ratio of the sleeve speed to the drum speed was 1.3. The drum had a diameter of 90 mm and rotated at a linear velocity of 200 mm/sec. The sleeve had a diameter of 30 mm. A single dot had a diameter of 42.4 $\mu$m. The gap for development was 0.5 mm. The developer was scooped up in an amount of 0.065 g/cm$^3$. Initially, the drum was uniformly charged to −700 V. A light portion had a potential VL of −150 V. The bias for development (experimental range) had a rectangular waveform having a frequency of 1 kHz to 12 kHz, a duty ratio of 5% to 80%, and a peak voltage of 800 V. The offset voltage had an effective value of −500 V. The above duty ratio is expressed as:

$$\text{duty ratio}=a/(a+b)\ (\times 100)\ \%$$

where a denotes the duration of a bias applied to the developing roller and causing the toner to move toward the drum, and b denotes the duration of a bias causing it to move in the opposite direction, i.e., toward the sleeve.

To estimate granularity, 2 cm square, solid patterns with 256 tones were formed by a particular quantity of light each and then developed. Subsequently, the halftone portions of the solid patterns were observed by eye. Patterns with no noticeable granularity were ranked "5" while patterns with the most noticeable granularity were ranked "1". FIG. 7 shows the results of estimation of halftone images executed by varying the frequency and duty ratio. In FIG. 7, "Time T2 ($\mu$s)" is representative of a period of time over which the bias causing the toner to move toward the drum is applied during one period of AC. Likewise, "Time T3 ($\mu$s) " is representative of a period of time over which the bias causing the toner to move toward the sleeve is applied during one period of oscillation.

In the conventional contact type developing method using a magnet brush, it is likely that the magnet brush contacts even toner particles present on the photoconductive element and makes a toner image to appear granular. This is presumably because toner in the magnet brush moves toward both of the photoconductive element and sleeve at the nip, and therefore a toner image moved away from the nip is the result of the feed of the toner from the magnet brush to a latent image and the return of the toner from the latent image to the magnet brush.

Figure 8:
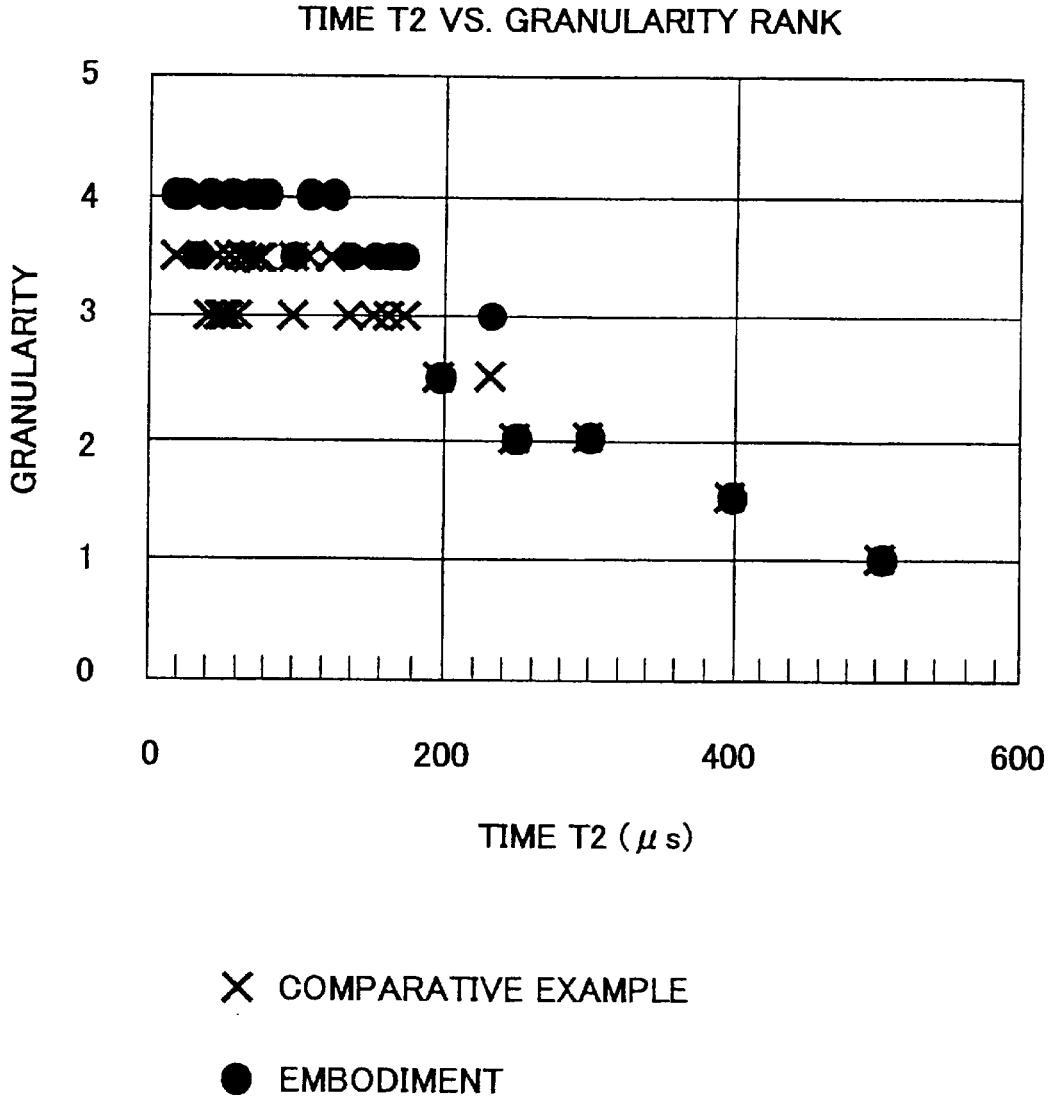
FIG. 8 is a graph showing a relation between granularity and the duration of an electric field that causes toner to move toward a photoconductive element in a single period of a bias for development.
Figure 10:
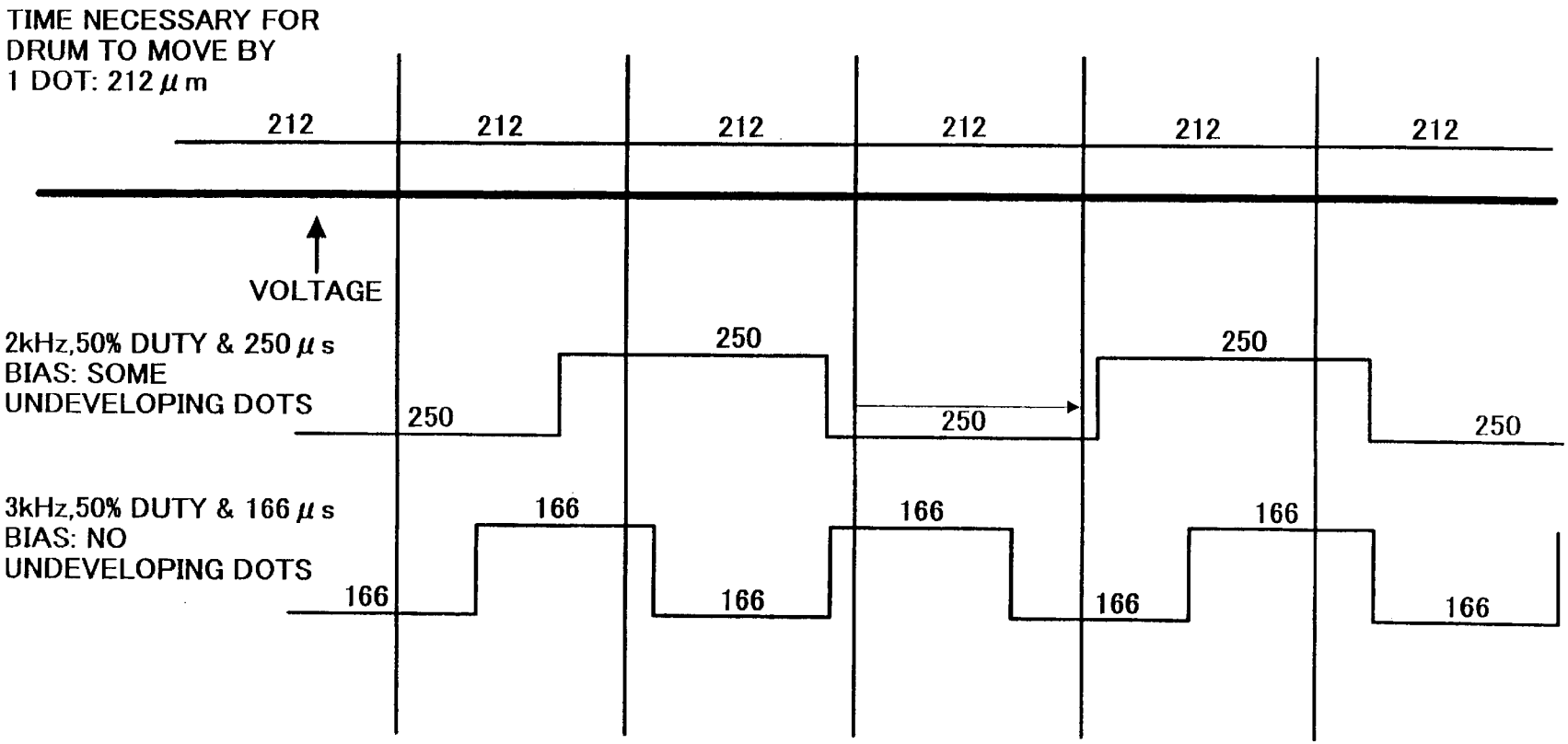
FIG. 10 is a timing chart demonstrating how the result of development depends on frequency and duration for the same duty.

As FIGS. 7 and 8 indicate, in both of the illustrative embodiment and comparative example, granularity is less noticeable when the time T2 is shorter than a time T1 (=212 $\mu$s) necessary for the photoconductive element to move by one dot at the nip. This is presumably accounted for by the following. When the time T2 is shorter than the time T2, the polarity of the bias for development changes within a single dot (direction of movement of the photoconductive element=direction of slide of the sleeve; subscanning direction). As a result, toner moves back and forth between the photoconductive element and the sleeve, promoting development. Conversely, when the time T2 is longer than or equal to the time T1, the polarity mentioned above sometimes does not vary within a single dot (see FIG. 10), preventing toner from moving back and forth. The resulting dot is not developed as sufficiently as the other dots; the amount of toner deposition on the photoconductive drum is smaller than when the time T2 is shorter than the time T1.

Figure 9:
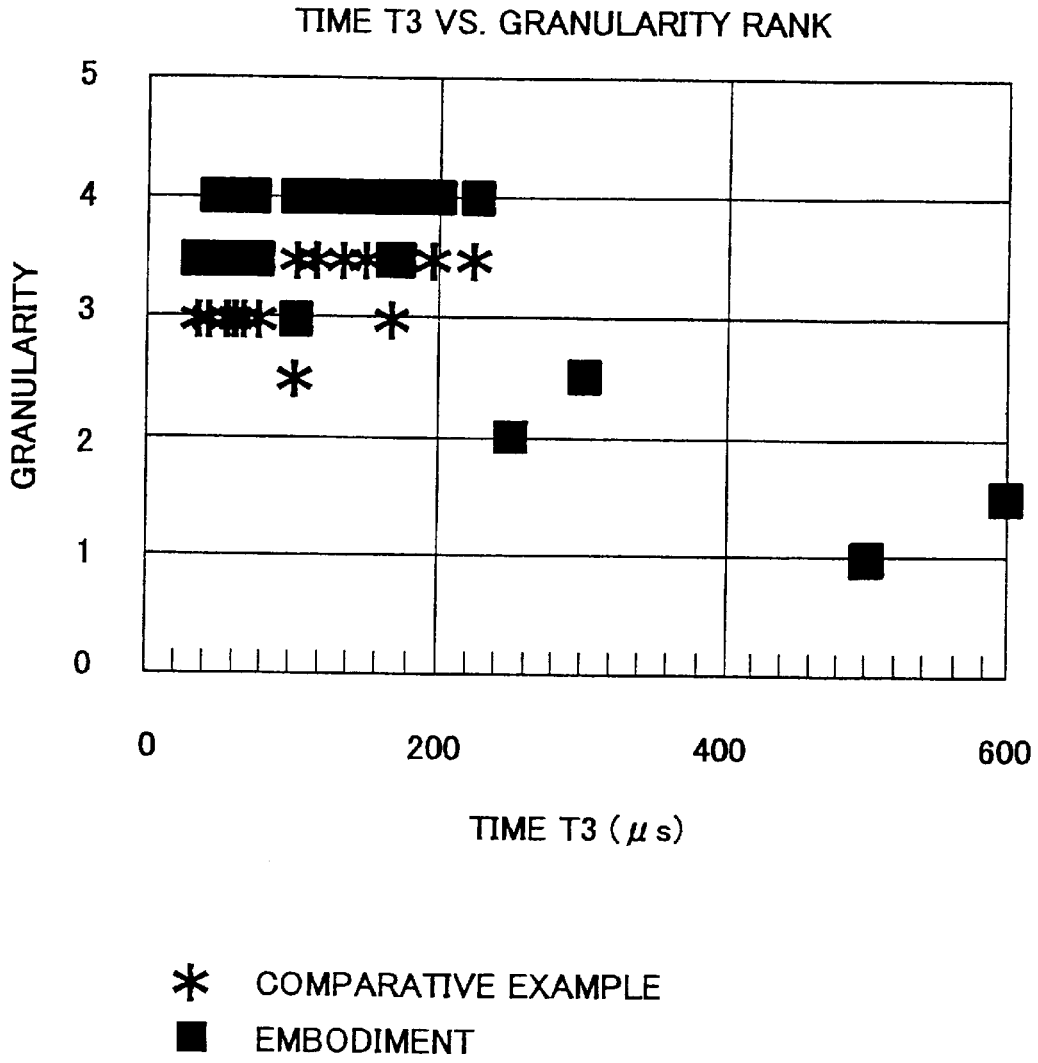
FIG. 9 is a is a graph showing a relation between granularity and the duration of an electric field that causes toner to move toward a developing sleeve in the single period.

Further, as FIGS. 7 and 9 indicate, granularity is less noticeable when the time T3 is shorter than the time T1 for the following reason. When the time T3 is shorter than the time T1, the polarity of the bias varies within a single dot in the same manner as when the time T2 is shorter than the time T1, insuring sufficient development. However, when the time T3 is longer than or equal to the time T1, the bias in the developing direction is sometimes not applied to a single dot (see FIG. 10), preventing the toner from depositing on the photoconductive element.

For the same conditions of T1>T2 and T1>T3, the illustrative embodiment reduces granularity more than the comparative example, as also determined by experiments. This is presumably accounted for by the following. The nip width between the magnet brush and the photoconductive element is several ten times as great as the size of a single dot. Therefore, a latent image present on the photoconductive element, which is in rotation, moves toward the downstream side of the nip and then leaves the nip while being rubbed by the consecutive brush chains. Even after toner deposition effected by the magnet brush and bias at the upstream side of the nip, some dots are rubbed by the brush chains due to the rotation of the sleeve while moving toward the downstream side of the nip. The AC bias continuously applied during such a period of time causes the toner to oscillate and move back and forth between the photoconductive element and the magnet brush. Consequently, in the comparative example using abroad nip, even after the toner has been uniformly deposited on the latent image at the upstream side of the nip, the toner continuously oscillates until it leaves the nip. This disturbs the toner image, i.e., makes it to appear granular.

More specifically, in the illustrative embodiment, relations of T1>T2>0 and T1>T3>0 are selected to insure the deposition of toner on a latent image at the upstream side of the nip. In addition, to insure a uniform halftone image, the attenuation ratio of flux density of the main pole in the normal direction is selected to be 40% or above to thereby reduce the nip width, i.e., the period of time during which a toner image is disturbed at the downstream side of the nip. Presumably, the narrow magnetic force distribution of the main pole particular to the illustrative embodiment forms a dense magnet brush within the small nip width and thereby increases the probability of contact of the developer with the photoconductive element, while promoting efficient charge migration from the sleeve to the photoconductive element.

Assume that the shortest distance between the doctor blade and the sleeve is Gd, and that the shortest distance between the photoconductive element and the sleeve is Gp. Then, if a ratio Gp/Gd is small, the developer scooped up by the scoop-up pole and then moved away from the doctor blade rushes into the gap for development, which is narrower than the doctor gap. Consequently, the developer is more dense when nipped between the photoconductive element and the sleeve at the developing region than when scooped up to the sleeve. In this sense, a small ratio Gp/Gd is desirable.

In summary, it will be seen that the present invention provides an image forming apparatus having the following various unprecedented advantages. Toner surely deposits on a latent image at the upstream side of a nip for development, freeing the resulting toner image from granularity. The nip has a width small enough to reduce a period of time during which the toner image is disturbed when brought to the downstream side of the nip. Further, the movement of the toner from the toner image formed on a photoconductive element toward a sleeve is reduced, obviating the omission of a single dot and therefore realizing a uniform halftone image.

Various modifications will become possible for those skilled in the art after receiving the teachings of the present disclosure without departing from the scope thereof.

What is claimed is:

1. A method of developing a latent image, which is formed on an image carrier, by feeding toner from a magnet brush formed on a developer carrier, said method comprising:

providing a flux density of a main magnetic pole, which forms the magnet brush in a developing region, in a normal direction with an attenuation ratio of 40% or above; and assuming that a period of time necessary for the image carrier to move by a single dot in the developing region is T1, and that, in a single period of an alternating electric field applied to the developer carrier as a bias for development, a duration of an electric field causing the toner to move toward said image carrier is T2, then setting up a relation of T1>T2>0.

2. The method as claimed in claim 1, further comprising, assuming that in the single period of the alternating electric field a duration of an electric field causing the toner to move toward the developer carrier is T3, then setting up a relation of T1>T3>0.

3. The method as claimed in claim 1, further comprising providing the bias with a frequency of 4 kHz to 9 kHz.

4. The method as claimed in claim 1, further comprising setting up a duty ratio, which is a ratio of the duration T2 to a duration of application of the bias, of 10% to 60%.

5. The method as claimed in claim 1, further comprising setting up a half width, which is an angular width determined by one half of a maximum magnetic force of a magnetic force distribution curve of said main magnetic pole in the normal direction, of 25° or below.

6. The method as claimed in claim 1, further comprising setting a ratio of a linear velocity of the developer carrier to a linear velocity of the image carrier of 1.3.

7. A method of developing a latent image, which is formed on an image carrier, by feeding toner from a magnet brush formed on a developer carrier, said method comprising:

providing a flux density of a main magnetic pole, which forms the magnet brush in a developing region, in a normal direction with an attenuation ratio of 40% or above; and assuming that a period of time necessary for the image carrier to move by a single dot in the developing region is T1, and that, in a single period of an alternating electric field applied to the developer carrier as a bias for development, a duration of an electric field causing the toner to move toward the developer carrier is T3, then setting up a relation of T1>T3>0.

8. The method as claimed in claim 7, further comprising providing the bias with a frequency of 4 kHz to 9 kHz.

9. The method as claimed in claim 7, further comprising setting up a duty ratio, which is a ratio of a duration of T2 of an electric field causing the toner to move toward the image carrier to a duration of application of the bias, of 10% to 60%.

10. The method as claimed in claim 7, further comprising setting up a half width, which is an angular width determined by one half of a maximum magnetic force of a magnetic force distribution curve of said main magnetic pole in the normal direction, of 25° or below.

11. The method as claimed in claim 7, further comprising setting a ratio of a linear velocity of the developer carrier to a linear velocity of the image carrier of 1.3.

12. A method of developing a latent image, which is formed on an image carrier, by feeding toner from a magnet brush formed on a developer carrier, said method comprising:

providing a flux density of a main magnetic pole, which forms the magnet brush in a developing region, in a normal direction with an attenuation ratio of 40% or above;

assuming that a period of time necessary for the image carrier to move by a single dot in the developing region is T1, and that, in a single period of an alternating electric field applied to the developer carrier as a bias for development, a duration of an electric field causing the toner to move toward said image carrier is T2, then setting up a relation of T1>T2>0;

providing the bias with a frequency of 4 kHz to 9 kHz; and setting up a duty ratio, which is a ratio of the duration T2 to a duration of application of the bias, of 10% to 60%.

13. The method as claimed in claim 12, further comprising setting up a half width, which is an angular width determined by one half of a maximum magnetic force of a magnetic force distribution curve of said main magnetic pole in the normal direction, of 25° or below.

14. The method as claimed in claim 12, further comprising setting a ratio of a linear velocity of the developer carrier to a linear velocity of the image carrier of 1.3.

15. A method of developing a latent image, which is formed on an image carrier, by feeding toner from a magnet brush formed on a developer carrier, said method comprising:

providing a flux density of a main magnetic pole, which forms the magnet brush in a developing region, in a normal direction with an attenuation ratio of 40% or above;

assuming that a period of time necessary for the image carrier to move by a single dot in the developing region is T1, and that, in a single period of an alternating electric field applied to the developer carrier as a bias for development, a duration of an electric field causing the toner to move toward the developer carrier is T3, then setting up a relation of T1>T3>0;

providing the bias with a frequency of 4 kHz to 9 kHz; and setting up a duty ratio, which is a ratio of a duration of T2 of an electric field causing the toner to move toward the image carrier to a duration of application of the bias, of 10% to 60%.

16. The method as claimed in claim 15, further comprising setting up a half width, which is an angular width determined by one half of a maximum magnetic force of a magnetic force distribution curve of said main magnetic pole in the normal direction, of 25° or below.

17. The method as claimed in claim 15, further comprising setting a ratio of a linear velocity of the developer carrier to a linear velocity of the image carrier of 1.3.

18. An image forming unit comprising:

a developing device including a main magnetic pole for causing a developer to form a magnet brush on a surface of a developer carrier;

an image carrier facing said developing device; and electric field generating means for generating an alternating electric field between said image carrier and said developer carrier;

wherein the main magnetic pole forming the magnet brush in a developing region has a flux density in a normal direction having an attenuation ratio of 40% or above; and assuming that a period of time necessary for said image carrier to move by a single dot in the developing region is T1, and that, in a single period of an alternating electric field applied to said developer carrier as a bias for development, a duration of an electric field causing the toner to move toward said image carrier is T2, then a relation of T1>T2>0 holds.

19. The unit as claimed in claim 18, wherein assuming that in the single period of the alternating electric field a duration of an electric field causing the toner to move toward said developer carrier is T3, then a relation of T1>T3>0 holds.

20. The unit as claimed in claim 18, the bias has a frequency of 4 kHz to 9 kHz.

21. The unit as claimed in claim 18, wherein a duty ratio, which is a ratio of the duration T2 to a duration of application of the bias, is 10% to 60%.

22. The unit as claimed in claim 18, wherein a half width, which is an angular width determined by one half of a maximum magnetic force of a magnetic force distribution curve of said main magnetic pole in the normal direction, is 25° or below.

23. The unit as claimed in claim 18, wherein a ratio of a linear velocity of said developer carrier to a linear velocity of said image carrier is 1.3.

24. An image forming unit comprising:

a developing device including a main magnetic pole for causing a developer to form a magnet brush on a surface of a developer carrier;

an image carrier facing said developing device; and electric field generating means for generating an alternating electric field between said image carrier and said developer carrier;

wherein the main magnetic pole forming the magnet brush in a developing region has a flux density in a normal direction having an attenuation ratio of 40% or above; and assuming that a period of time necessary for said image carrier to move by a single dot in the developing region is T1, and that, in a single period of an alternating electric field applied to said developer carrier as a bias for development, a duration of an electric field causing the toner to move toward the developer carrier is T3, then a relation of T1>T3>0 holds.

25. The unit as claimed in claim 24, wherein the bias has a frequency of 4 kHz to 9 kHz.

26. The unit as claimed in claim 24, wherein a duty ratio, which is a ratio of a duration of T2 of an electric field causing the toner to move toward said image carrier to a duration of application of the bias, is 10% to 60%.

27. The unit as claimed in claim 24, wherein a half width, which is an angular width determined by one half of a maximum magnetic force of a magnetic force distribution curve of said main magnetic pole in the normal direction, is 25° or below.

28. The method as claimed in claim 24, wherein a ratio of a linear velocity of said developer carrier to a linear velocity of said image carrier is 1.3.

29. An image forming unit comprising:

a developing device including a main magnetic pole for causing a developer to form a magnet brush on a surface of a developer carrier;

an image carrier facing said developing device; and electric field generating means for generating an alternating electric field between said image carrier and said developer carrier;

wherein the main magnetic pole forming the magnet brush in a developing region has a flux density in a normal direction having an attenuation ratio of 40% or above;

assuming that a period of time necessary for said image carrier to move by a single dot in the developing region is T1, and that, in a single period of an alternating electric field applied to said developer carrier as a bias for development, a duration of an electric field causing the toner to move toward said image carrier is T2, then a relation of T1>T2>0 holds;

the bias has a frequency of 4 kHz to 9 kHz; and a duty ratio, which is a ratio of the duration T2 to a duration of application of the bias, is 10% to 60%.

30. The unit as claimed in claim 29, wherein a half width, which is an angular width determined by one half of a maximum magnetic force of a magnetic force distribution curve of said main magnetic pole in the normal direction, is 25° or below.

31. The unit as claimed in claim 29, wherein a ratio of a linear velocity of said developer carrier to a linear velocity of said image carrier is 1.3.

32. An image forming unit comprising:

a developing device including a main magnetic pole for causing a developer to form a magnet brush on a surface of a developer carrier;

an image carrier facing said developing device; and electric field generating means for generating an alternating electric field between said image carrier and said developer carrier;

wherein the main magnetic pole forming the magnet brush in a developing region, has a flux density in a normal direction having an attenuation ratio of 40% or above;

assuming that a period of time necessary for said image carrier to move by a single dot in the developing region is T1, and that, in a single period of an alternating electric field applied to said developer carrier as a bias for development, a duration of an electric field causing the toner to move toward said developer carrier is T3, then a relation of T1>T3>0 holds;

the bias has a frequency of 4 kHz to 9 kHz; and a duty ratio, which is a ratio of a duration of T2 of an electric field causing the toner to move toward the image carrier to a duration of application of the bias, is 10% to 60%.

33. The unit as claimed in claim 32, wherein a half width, which is an angular width determined by one half of a maximum magnetic force of a magnetic force distribution curve of said main magnetic pole in the normal direction, is 25° or below.

34. The unit as claimed in claim 32, wherein a ratio of a linear velocity of said developer carrier to a linear velocity of said image carrier is 1.3.

35. An image forming apparatus comprising:

a developing device including a main magnetic pole for causing a developer to form a magnet brush on a surface of a developer carrier;

an image carrier facing said developing device; and electric field generating means for generating an alternating electric field between said image carrier and said developer carrier;

wherein the main magnetic pole forming the magnet brush in a developing region has a flux density in a normal direction having an attenuation ratio of 40% or above; and assuming that a period of time necessary for said image carrier to move by a single dot in the developing region is T1, and that, in a single period of an alternating electric field applied to said developer carrier as a bias for development, a duration of an electric field causing the toner to move toward said image carrier is T2, then a relation of T1>T2>0 holds.

36. An image forming apparatus comprising:

a developing device including a main magnetic pole for causing a developer to form a magnet brush on a surface of a developer carrier;

an image carrier facing said developing device; and electric field generating means for generating an alternating electric field between said image carrier and said developer carrier;

wherein the main magnetic pole forming the magnet brush in a developing region has a flux density in a normal direction having an attenuation ratio of 40% or above; and assuming that a period of time necessary for said image carrier to move by a single dot in the developing region is T1, and that, in a single period of an alternating electric field applied to said developer carrier as a bias for development, a duration of an electric field causing the toner to move toward the developer carrier is T3, then a relation of T1>T3>0 holds.

37. An image forming apparatus comprising:

a developing device including a main magnetic pole for causing a developer to form a magnet brush on a surface of a developer carrier;

an image carrier facing said developing device; and electric field generating means for generating an alternating electric field between said image carrier and said developer carrier;

wherein the main magnetic pole forming the magnet brush in a developing region has a flux density in a normal direction having an attenuation ratio of 40% or above;

assuming that a period of time necessary for said image carrier to move by a single dot in the developing region is T1, and that, in a single period of an alternating electric field applied to said developer carrier as a bias for development, a duration of an electric field causing the toner to move toward said image carrier is T2, then a relation of T1>T2>0 holds;

the bias has a frequency of 4 kHz to 9 kHz; and a duty ratio, which is a ratio of the duration T2 to a duration of application of the bias, is 10% to 60%.

38. An image forming apparatus comprising:

a developing device including a main magnetic pole for causing a developer to form a magnet brush on a surface of a developer carrier;

an image carrier facing said developing device; and electric field generating means for generating an alternating electric field between said image carrier and said developer carrier;

wherein the main magnetic pole forming the magnet brush in a developing region, has a flux density in a normal direction having an attenuation ratio of 40% or above;

assuming that a period of time necessary for said image carrier to move by a single dot in the developing region is T1, and that, in a single period of an alternating electric field applied to said developer carrier as a bias for development, a duration of an electric field causing the toner to move toward said developer carrier is T3, then a relation of T1>T3>0 holds;

the bias has a frequency of 4 kHz to 9 kHz; and a duty ratio, which is a ratio of a duration of T2 of an electric field causing the toner to move toward the image carrier to a duration of application of the bias, is 10% to 60%.

* * * * *